US007854252B2

(12) United States Patent
Song et al.

(10) Patent No.: US 7,854,252 B2
(45) **Date of Patent: *Dec. 21, 2010**

(54) METHOD OF PRODUCING A CASTABLE HIGH TEMPERATURE ALUMINUM ALLOY BY CONTROLLED SOLIDIFICATION

(75) Inventors: Shihong Gary Song, South Windsor, CT (US); Raymond C. Benn, Madison, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/512,298

(22) Filed: Jul. 30, 2009

(65) Prior Publication Data

US 2009/0288796 A1 Nov. 26, 2009

Related U.S. Application Data

(63) Continuation of application No. 11/231,479, filed on Sep. 21, 2005, now Pat. No. 7,584,778.

(51) Int. Cl.
*B22C 9/04* (2006.01)
*B22D 27/04* (2006.01)

(52) U.S. Cl. ..... 164/122.1; 164/516

(58) Field of Classification Search ..... 164/122.1, 164/122.2, 516–519

See application file for complete search history.

(56) References Cited

U.S. PATENT DOCUMENTS 3,807,016 A 4/1974 Schoerner et al.
3,807,969 A 4/1974 Schoerner et al.
3,811,846 A 5/1974 Schoerner et al.
3,830,635 A 8/1974 Chia et al.
4,806,307 A 2/1989 Hirose et al.

(Continued)

FOREIGN PATENT DOCUMENTS

EP 0225226 6/1987

(Continued)

OTHER PUBLICATIONS

Title 40—Protection of Environment, Sec. 86.004-11 Emission standards for 2004 and later model year diesel heavy-duty engines and vehicles, Jul. 1, 2001.

(Continued)

*Primary Examiner*—Kuang Lin
(74) *Attorney, Agent, or Firm*—Carlson, Gaskey & Olds

(57) ABSTRACT

A castable high temperature aluminum alloy is cast by controlled solidification that combines composition design and solidification rate control to synergistically enhance the performance and versatility of the castable aluminum alloy for a wide range of elevated temperature applications. In one example, the aluminum alloy contains by weight approximately 1.0-20.0% of rare earth elements that contribute to the elevated temperature strength by forming a dispersion of insoluble particles via a eutectic microstructure. The aluminum alloy also includes approximately 0.1 to 15% by weight of minor alloy elements. Controlled solidification improves microstructural uniformity and refinement and provides the optimum structure and properties for the specific casting condition. The molten aluminum alloy is poured into an investment casing shell and lowered into a quenchant at a controlled rate. The molten aluminum alloy cools from the bottom of the investment casting shell upwardly to uniformly and quickly cool the aluminum alloy.

26 Claims, 5 Drawing Sheets

U.S. PATENT DOCUMENTS

| | | | | |
|---|---|---|---|---|
| 4,851,193 | A | 7/1989 | Mahajan et al. | |
| 4,874,440 | A | 10/1989 | Sawtell et al. | |
| 4,915,903 | A | 4/1990 | Brupbacher et al. | |
| 4,983,358 | A | 1/1991 | Hebsur et al. | |
| 5,037,608 | A | 8/1991 | Tarcy et al. | |
| 5,045,278 | A | 9/1991 | Das et al. | |
| 5,055,257 | A | 10/1991 | Chakrabarti et al. | |
| 5,055,527 | A | 10/1991 | Bronstert et al. | |
| 5,087,301 | A | 2/1992 | Angers et al. | |
| 5,503,798 | A | 4/1996 | Singheiser et al. | |
| 5,607,523 | A * | 3/1997 | Masumoto et al. | 148/415 |
| 5,624,632 | A | 4/1997 | Baumann et al. | |
| 5,776,617 | A | 7/1998 | Brady et al. | |
| 5,811,058 | A | 9/1998 | Baba et al. | |
| 5,830,288 | A | 11/1998 | Gigliotti, Jr. et al. | |
| 6,135,199 | A | 10/2000 | Wyatt-Mair | |
| 6,248,453 | B1 | 6/2001 | Watson | |
| 6,258,318 | B1 | 7/2001 | Lenczowski et al. | |
| 6,315,948 | B1 | 11/2001 | Lenczowski et al. | |
| 6,607,355 | B2 | 8/2003 | Cunha et al. | |
| 6,622,774 | B2 | 9/2003 | Song | |
| 7,131,483 | B2 | 11/2006 | Osanai et al. | |
| 2004/0055671 | A1 | 3/2004 | Olson et al. | |
| 2004/0156739 | A1 | 8/2004 | Song | |

FOREIGN PATENT DOCUMENTS

| | | |
|---|---|---|
| EP | 0958393 | 11/1999 |
| EP | 1111078 | 6/2001 |
| EP | 1471157 | 10/2004 |
| EP | 1561831 | 8/2005 |
| GB | 2272451 | 5/1994 |
| JP | 1-283335 | 11/1989 |
| JP | 3-111533 | 5/1991 |
| JP | 4-13830 | 1/1992 |
| JP | 4-136141 | 5/1992 |
| JP | 10-81929 | 3/1998 |
| JP | 2001-511847 | 8/2001 |
| JP | 2002-250791 | 9/2002 |
| JP | 2004-105978 | 4/2004 |
| JP | 2005-220441 | 8/2005 |
| JP | 2005-224834 | 8/2005 |
| WO | 96/10099 | 4/1996 |
| WO | 03/104505 | 12/2003 |

OTHER PUBLICATIONS

Binary Alloy Phase Diagrams:, T.B. Massalski; J.L. Murray; L.H. Bennett, Sam, (1986) pp. 110-111, 114-115, 127, 129, 179, 182-184.
C. Barret and T.B. Massalski, Structure of Metals, 3rd edition, Pergamon Press, (1980), pp. 486-534.
M.C. Flemings, Solidification Processing, McGraw Hill, (1974), pp. 12-17.
T.W. Clyne and P.J. Withers, An introduction to Metal Matrix Composites, Cambridge University Press, (1993), pp. 1-11.
J.E. Hatch, Aluminum—Properties and Physical Metallurgy, ASM, Metal Park, OH (1984), pp. 32-39.
P. Haasen, "Physical Metallurgy", 2nd edition (1986), Cambridge University Press, pp. 348-356.
W.A. Kaysser, "Powder Metallurgy for Aerospace Applications", (1994), DLR, German Aerospace Researsch Establishment, Institute of Materials Research, Germany, pp. 3-9.
A. Lawley, Elevated Temperature Aluminum Alloys, The Institute of Metals, London, (1994), pp. 66-75.
Vittorio D'Angelo; Gabriele Tancorre; Sergio Vittori, Properties of "Primal" Aluminium—7% Silicon Casting Alloys, Feb. 1981—Alluminio, pp. 90-94.
A.D. Jatkar; R.R. Sawtell, Aluminum PM Alloys for Aerospace Applications, International Conference on PM Aerospace Materials, (1991), pp. 15-1-15-13.
S.K. Das; L.A. Davis, High Performance Aerospace Alloys via Rapid Solidification Processing, Materials Science and Engineering, (1988), pp. 1-12.
WM. D. Pollock; F.E. Wawner; "Microstructure and Mechanical Properties of High Temperature Aluminum Composites", Symposium on High Temperatures Composites, Technomic Publishing Co., Inc. Lancaster, (19890, pp. 61-71, 1989).
S.L. Langenbeck; W.M. Griffith; G.J. Hildeman; J.W.Simon, "Development of Dispersion-Strengthed Aluminum Alloys", Langenbeck et al. on Dispersion-Strengthened Alloys, pp. 410-422, ASTM STP 890, 1986.
E.W. Blumer, "High Temperature Aluminum Alloy Applications,", The Minerals, Metals & Materials Society, (1991), pp. 241-250.
A.V. Kurdyumov; S.V. Inkin; R. Bekher; I. Bekher, "Influence of Certain Elements on Structure and Surface Tension of Grade AL4 Alloys After Sodium and Strontium Treatments", Liteinoe Proizvodstvo, No. 7, (1988), pp. 16-19.
Partial European Search Report dated Sep. 11, 2007.
Database CA (Online), Chemical Abstracts Service, Columbus, OH. Nov. 29, 2002; Song, S.G.: "Dispersion Strengthened Case AI-RE Alloy for Elevated Temperature Applications" XP002450011 & Advances in Aluminum Casting Technology II, Proceeding From Materials Solutions Conference 2002, International Aluminum Casting Technology Symposium, 2nd. Columbus, OH Oct. 7-9, 2002, 197-202.
Gangopadhyay A.K. et al. "Effect of Rare-Earth Atomic Radius on the Devitrification of AL88RE8NI4 Amorphous Alloys" Philosophical Magazine, Physics of Condensed Matter: Structure, Defects and Mechanical Properties, Taylor & Francis, London, GB; vol. 80, No. 5, 2000, pp. 1193-1206.
Japanese Office Action dated Nov. 4, 2008.

* cited by examiner

METHOD OF PRODUCING A CASTABLE HIGH TEMPERATURE ALUMINUM ALLOY BY CONTROLLED SOLIDIFICATION

REFERENCE TO RELATED APPLICATIONS

The present invention is a continuation of U.S. patent application Ser. No. 11/231,479 filed Sep. 21, 2005 now U.S. Pat. No. 7,584,778.

BACKGROUND OF THE INVENTION

The present invention relates generally to a method for producing an aluminum alloy suitable for elevated temperature applications by controlled solidification that combines composition design and solidification rate control to enhance the aluminum alloy performance.

Gas turbine engine components are commonly made of titanium, iron, cobalt and nickel based alloys. During use, many components of the gas turbine engine are subjected to elevated temperatures. Lightweight metals, such as aluminum and magnesium and alloys of these metals, are often used for some components to enhance performance and to reduce the weight of engine components. A drawback to employing conventional aluminum alloys is that the strength of these alloys drops rapidly at temperatures above 150° C., making these alloys unsuitable for certain elevated temperature applications. Current aluminum alloys, either wrought or cast, are intended for applications at temperatures below approximately 180° C. (355° F.) in the T6 condition (solution treated, quenched and artificially aged).

Several high temperature aluminum alloys have been developed, but few product applications exist despite the weight benefits. This is partially because of the slow acceptance of any new alloy in the aerospace industry and also because high temperature aluminum alloys have fabrication limitations that can counter their adoption for production uses. Many of the potential components for which high temperature alloys could be used are produced using welding, brazing or casting. Fabrication of these components using wrought high temperature aluminum alloys (including powder metallurgy routes) may be possible, but the cost often becomes prohibitive and limits production to very simple parts. Conversely, it is difficult to develop high temperature property improvements in aluminum alloys that are fabricated into complex shapes by conventional casting, the least expensive process.

Recently, there have been improvements in the casting technology of aluminum alloys, e.g., aluminum-silicon based alloys such as D-357. These improvements have allowed for "controlled solidification" of aluminum-silicon alloys, similar to those improvements achieved in the liquid-metal cooling of directional/single crystal superalloys. This can provide considerable refinement and uniformity of grain and precipitate morphologies to improve the combined strength and ductility consistently throughout the casting. This provides a robust quality to the properties that component designers need in current alloy compositions, such as D-357. However, these alloys do not meet the level of properties needed for higher temperature applications. New composition designs are needed that combine synergistically with controlled solidification technology to significantly increase the high temperature capabilities.

Hence, there is a need in the art for a method for producing an aluminum alloy by controlled solidification that combines composition design and solidification rate control, that is designed to synergistically enable the production of complex cast components for high temperature applications (e.g., gas turbine and automotive engine components and structures) and that overcomes the other shortcomings and drawbacks of the prior art.

SUMMARY OF THE INVENTION

Certain components of a gas turbine engine can be made of a high temperature aluminum-rare earth element alloy. One example aluminum alloy includes approximately 1.0 to 20.0% by weight of rare earth elements, including any combination of one or more of ytterbium, gadolinium, yttrium, erbium and cerium. The aluminum alloy also includes approximately 0.1 to 15% by weight of minor alloy elements including any combination of one or more of copper, nickel, zinc, silver, magnesium, strontium, manganese, tin, calcium, cobalt and titanium. The remainder of the alloy composition is aluminum.

During solidification, the aluminum matrix excludes the rare earth elements from the aluminum matrix, forming eutectic rare earth-containing insoluble dispersoids that strengthen the aluminum matrix. The optimal composition and solidification rate of the aluminum alloy is determined by analyzing the resulting structure and the mechanical properties of the aluminum alloy at different compositions and solidification conditions. Controlled solidification combines composition design and solidification rate control of the aluminum alloy to synergistically produce suitable structures for high temperature use. The aluminum alloy is then formed into the desired shape by casting, including investment casting, die casting and sand casting.

In one example, complex shapes can be cast with good details by investment casting. Molten aluminum alloy having the desired composition is poured inside an investment casting shell. The investment casting shell is then lowered into a quenchant, e.g., a solution of water and a water soluble material that is heated to approximately 100° C., to rapidly cool the molten aluminum alloy. The solidification rate can be controlled by controlling the rate that the investment casting shell is lowered into the quenchant. The aluminum alloy at the bottom of the investment casting shell begins to cool first. As the aluminum alloy cools, the solidified aluminum alloy helps to extract heat from the molten aluminum alloy above the cool solidified alloy, quickly and uniformly extracting heat from the molten aluminum alloy. The solidification propagates vertically to the top of the investment casting shell until the molten aluminum alloy is completely solid.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
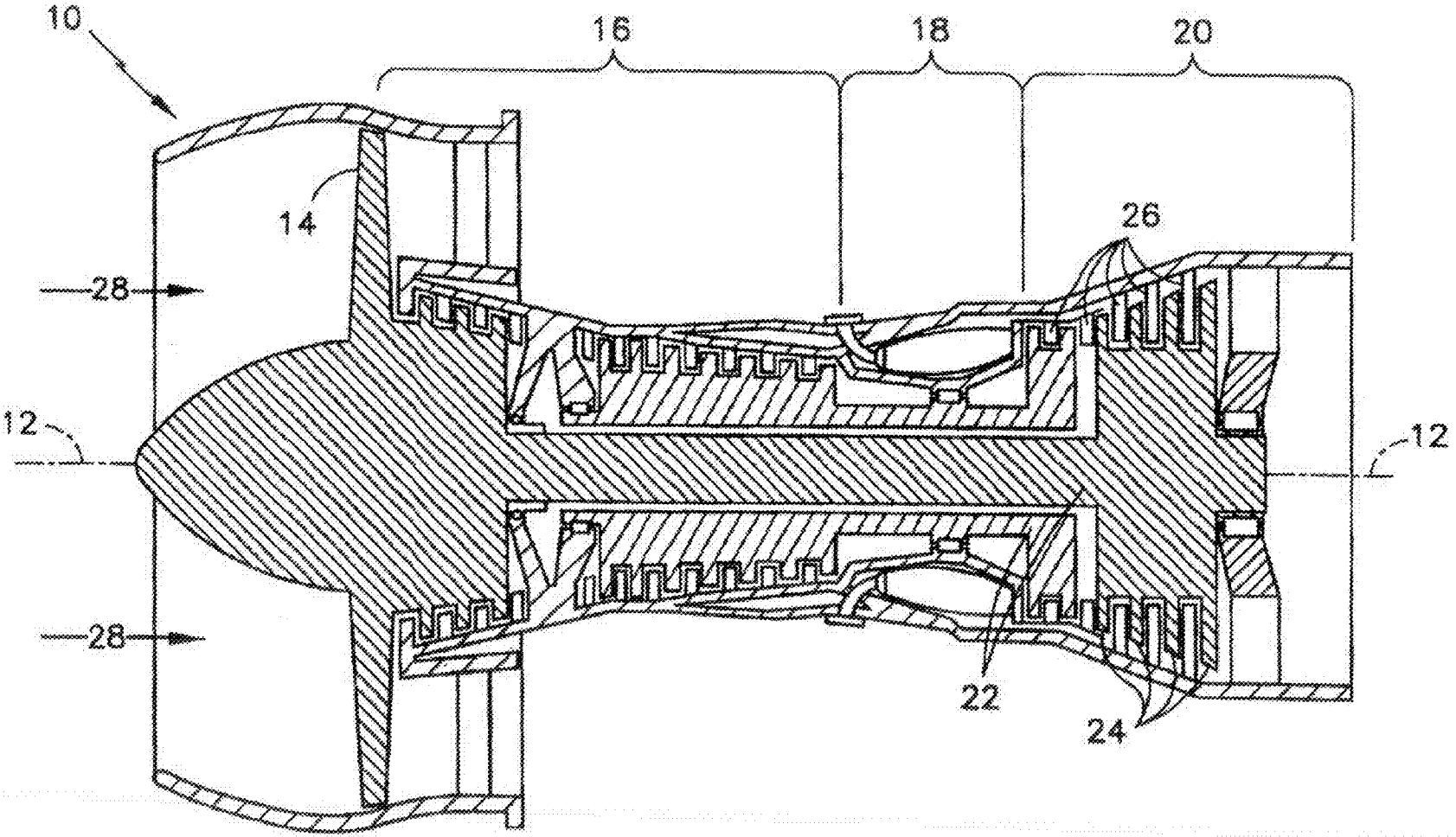
FIG. 1 schematically illustrates a gas turbine engine incorporating a castable high temperature aluminum alloy of the present invention.

FIG. 1 schematically illustrates a gas turbine engine 10 used for power generation or propulsion. The gas turbine engine 10 has an axial centerline 12 and includes a fan 14, a compressor 16, a combustion section 18 and a turbine 20. Air compressed in the compressor 16 is mixed with fuel and burned in the combustion section 18 and expanded in the turbine 20. The air compressed in the compressor 16 and the fuel mixture expanded in the turbine 20 are both referred to as a hot gas stream flow 28. Rotors 22 of the turbine 20 rotate in response to the expansion and drive the compressor 16 and the fan 14. The turbine 20 also includes alternating rows of rotary airfoils or blades 24 on the rotors and static airfoils or vanes 26.

Certain components of the gas turbine engine 10 can be made of an aluminum-rare earth element alloy. One example aluminum alloy includes approximately 1.0 to 20.0% by weight of rare earth elements, including any combination of one or more of ytterbium (Yb), gadolinium (Gd), yttrium (Y), erbium (Er) and cerium (Ce). The aluminum alloy also includes approximately 0.1 to 15% by weight of minor alloy elements including any combination of one or more of copper, nickel, zinc, silver, magnesium, strontium, manganese, tin, calcium, cobalt and titanium. The remainder of the alloy composition is aluminum.

During solidification, the aluminum matrix excludes the rare earth elements, forming eutectic rare earth-containing insoluble dispersoids that contribute to the elevated temperature strength of the aluminum alloy. The minor alloy elements provide different functions to the primary eutectic. Zinc, magnesium and to a lesser extent nickel, copper and silver contribute to precipitation hardening the aluminum alloy up to approximately 180° C. The precipitates are re-solutionized at ~260° C. and contribute little to elevated temperature strength, other than solid solution hardening. Strontium and calcium are added for chemical modification of the eutectic, but this can be overridden by significant physical modification obtained with higher solidification rates.

In one embodiment, the aluminum alloy includes approximately 1.0 to 20.0% by weight of a rare earth element selected from ytterbium and gadolinium and approximately 0.1 to 10.0% by weight of at least one second rare earth element selected from gadolinium, ytterbium, yttrium, erbium and cerium. Preferably, the aluminum alloy includes approximately 12.5 to 15.0% ytterbium and approximately 3.0 to 5.0% yttrium. More preferably, the aluminum alloy includes approximately 12.9 to 13.2% ytterbium and approximately 3.0 to 4.0% yttrium.

In another embodiment, the aluminum alloy includes minor alloy elements including by weight approximately 0.5 to 5.0% copper (Cu), approximately 0.1 to 4.5% nickel (Ni), approximately 0.1-5.0% zinc (Zn), approximately 0.1 to 2.0% magnesium (Mn), approximately 0.1 to 1.5% silver (Ag), approximately 0.01 to 1.0% strontium (Sr), zero to approximately 0.05% manganese (Mg) and zero to approximately 0.05% calcium (Ca). Preferably, the aluminum alloy includes approximately 1.0 to 3.0% copper, approximately 0.5 to 1.5% nickel, approximately 2.0 to 3.0% zinc, approximately 0.5 to 1.5% magnesium, approximately 0.5 to 1.0% silver, and approximately 0.02 to 0.05% strontium.

One example aluminum alloy includes approximately 2.5 to 15.0% ytterbium, approximately 3.0 to 5.0% yttrium, approximately 0.5 to 5.0% copper, approximately 0.1 to 4.5% nickel, approximately 0.1 to 5.0% zinc, approximately 0.1 to 2.0% magnesium, approximately 0.1 to 1.5% silver, approximately 0.01 to 1.0% strontium, zero to approximately 0.05% manganese and zero to approximately 0.05% calcium. More preferably, the aluminum alloy includes approximately 1.0 to 3.0% copper, approximately 0.5 to 1.5% nickel, approximately 2.0 to 3.0% zinc, approximately 0.5 to 1.5% magnesium, approximately 0.5 to 1.0% silver, and approximately 0.02 to 0.05% strontium.

The castability of an aluminum alloy relates primarily to the composition and the solidification rate of the aluminum alloy. Selective control of the composition and the solidification rate maximizes the formation of fine, uniform eutectic structures in the aluminum alloy casting. The optimum structure and properties can be obtained for several casting conditions, including sand casting, investment casting, permanent mold-casting and die casting. A castable high temperature aluminum (CHTA) alloy can be provided that can form complex castings having good higher temperature performance capabilities.

The optimal composition of the aluminum alloy for a given application is determined by analyzing the resulting structure and the mechanical properties of the aluminum alloy at different solidification conditions. First, the mechanical properties of a specific composition of the aluminum alloy are evaluated at a fixed solidification rate. The composition of the aluminum alloy is changed, and the mechanical properties are evaluated until the composition with the optimal mechanical properties is obtained. Once the optimal composition is obtained, the solidification rate of the aluminum alloy is changed until the mechanical properties of the aluminum alloy are further improved. This determines the optimal solidification rate for the aluminum alloy composition. From these two characteristics, further minor adjustments to the composition and/or the solidification rate may be made to maximize their synergistic effects in a robust, high temperature aluminum alloy.

The composition of the aluminum alloy is also tailored to the particular solidification conditions prevalent for the casting. An essentially richer composition with an increased amount of transition metals such as copper and nickel can be used at high solidification rates (such as rates typical of investment casting and die casting) to maximize strength properties. A leaner composition with a decreased amount of transition metals such as copper and nickel to compensate for matrix strength loss in coarser structures can be used at slower solidification rates (such as rates typical of sand casting).

The aluminum alloy with the desired composition is then cast at the desired solidification rate. For example, the aluminum alloy can be cast by sand casting (~5-50° C./min), investment casting (~50-200° C./min) and die casting (~5000-50,000° C./min).

Controlled solidification of the aluminum alloy provides microstructural uniformity, refinement and synergistic improvements to the structure and the properties of the suitably designed aluminum alloy. The performance, versatility, thermal stability and strength of the aluminum alloy are enhanced for a large range of elevated temperature applications up to approximately 375° C., beyond the scope of the current aluminum alloys. The aluminum alloy castings can extend the performance and reduce the weight and the cost of components generally manufactured from current materials (including aluminum, titanium, iron, nickel based alloys, etc). The combination of compositional design and casting process control produces structural refinement and uniform distribution of the eutectic rare earth-containing insoluble dispersoids. This synergism reduces the level of stress-raising structural features and provides improved ductility and notch sensitivity. Therefore, a basis for improved creep resistance and structural stability is formed. Similarly, the structural refinement and uniform eutectic phase distribution allows corrosion attack to be dispersed more evenly across the aluminum alloy surface, thereby providing better pitting resistance than conventional aluminum alloys.

In one example, after the optimal composition and the solidification rate of the aluminum alloy are determined, the aluminum alloy is investment cast using the controlled solidification process. Investment casting allows complex shapes to be cast with good details at a relatively fast solidification rate of ~50-100° C./min, producing the desired structural refinement. In investment casting, a wax form having the shape of the final part is first formed. A coating of ceramic, e.g., slurry and stucco, is then applied to the wax form. The number of layers of ceramic depends on the thickness of ceramic needed, and one skilled in the art would know how many layers to employ. The ceramic coated wax form is then heated in a furnace to melt and remove the wax, leaving the ceramic investment casting shell.

The investment casting shell is heated, and molten aluminum alloy is poured into the heated investment casting shell. The investment casting shell is then lowered into a quenchant, such as a liquid solution of water and a water soluble material (such as polyethylene glycol) heated to approximately 100° C., to rapidly cool the molten aluminum alloy. The solidification rate is controlled by controlling the rate that the investment casting shell is lowered into the quenchant. The slower the investment casting shell is lowered into the quenchant, the slower the solidification rate. The faster the investment casting shell is lowered into the quenchant, the faster the solidification rate.

The molten aluminum alloy at the bottom of the investment casting shell starts to cool first. The cooled solid alloy under and in contact with the above molten aluminum alloy helps to extract heat from the molten aluminum alloy. As the shell is immersed in the liquid, the solidification propagates vertically towards the top of the investment casting shell until the molten alloy is completely solid to extract heat quickly and uniformly from the molten aluminum alloy. The solution of water and the water soluble material extracts heat more rapidly from the aluminum alloy than cooling the molten aluminum alloy in air.

Investment casting can be utilized for engine housing manufacturing and for other parts having complex shapes, allowing for more design flexibility. Although relatively expensive because of the tooling and the process of shell molds, investment casting is beneficial for making engine parts having a complex geometry, allowing parts to be cast with greater precision and complexity.

Although investment casting has been described, it is to be understood that any type of casting can be used. For example, the component of aluminum alloy can be formed by die casting or sand casting. One skilled in the art would know what type of casting to employ.

During casting, solidification conditions are controlled to promote desirable eutectic-based microstructures and to provide high temperature performance. These features are also related to the type of growth front (the movement of the liquid and solid interface as the aluminum alloy solidifies) of the solidifying alloy. A solute-rich zone may build-up ahead of the advancing solidification front, leading to constitutional super-cooling of the melt due to solute rejection on solidification. Constitutional super-cooling is calculated by the ratio G/R, where G equals the temperature gradient of the liquid ahead of the front and R equals the front growth rate. The steep thermal gradient in the liquid phase promotes a planar solidification front with reduced diffusion distances and suppresses the degree of constitutional super-cooling, which is the main factor that measures the stability of the growth conditions and controls the type of growth front.

The steep temperature gradient causes rapid solidification, reducing the grain size and dendrite arm spacing (DAS) in the resultant part. The dendrite arm spacing or the phase interparticle spacing ($\lambda$) and the solidification rate (R) are related by the equation $\lambda^2 R$=constant. As the solidification rate increases, the interparticle spacing of the dispersed rare earth phase decreases logarithmically, resulting in structure refinement and desirable mechanical property improvements. The steep temperature gradient reduces interdendritic micro-porosity formation, which is advantageous given the high shrinkage ratio of typical high temperature alloy compositions.

When an alloy deviates from the eutectic composition, it is still possible to maintain a eutectic-like microstructure if solidification is carried out in a sufficiently steep temperature gradient or at a sufficiently slow rate. Alloying elements can, therefore, be added to modify the chemistry of the phases and their volume fractions to develop a complex high temperature eutectic alloy. In ternary and higher-order eutectics, the total volume fraction of eutectic phases generally increases, leading to a finer structure in the resultant eutectic composition. When these compositions are combined with controlled solidification, synergistic improvements in structure and properties are possible.

Figure 2:
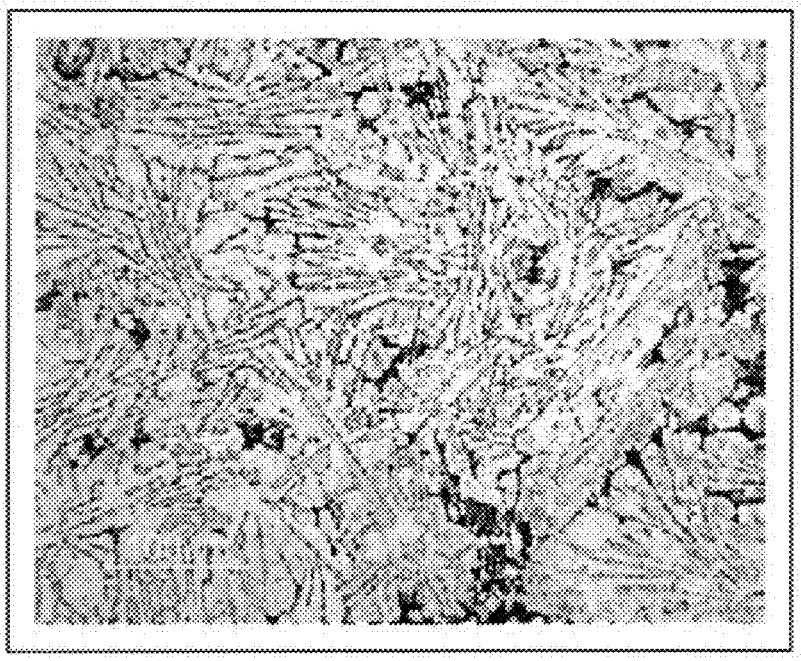
FIG. 2 is a micrograph illustrating a castable high temperature aluminum alloy sand cast microstructure at 200 times magnification which is not cast under controlled solidification.

FIG. 2 illustrates a micrograph showing the microstructure of a sand cast CHTA alloy at 200 times magnification, which was not cast under controlled solidification. Under slower solidification rates typical of sand casting (~10° C./min), the morphology of the $\alpha$Al—$Al_3$(REM) e.g., $\alpha$Al—$Al_3$(Yb,Y) eutectic is typically flake-like and angular. The dendrite arm spacing and the interparticle spacing between the $\alpha$Al and the $Al_3$(REM) phases are relatively coarse, and most of the $Al_3$(REM) particles are connected and continuous. The $Al_3$(Yb,Y) phase morphology is thermally stable, but its morphology is not optimized for dispersion strengthening.

Figure 3:
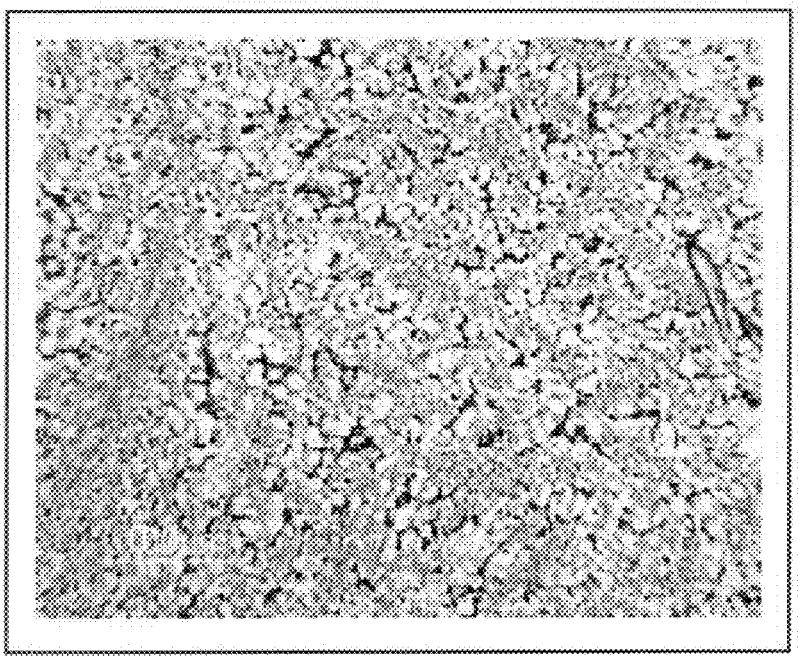
FIG. 3 is a micrograph illustrating a castable high temperature aluminum alloy controlled solidification microstructure investment cast at 200 times magnification.
Figure 4:
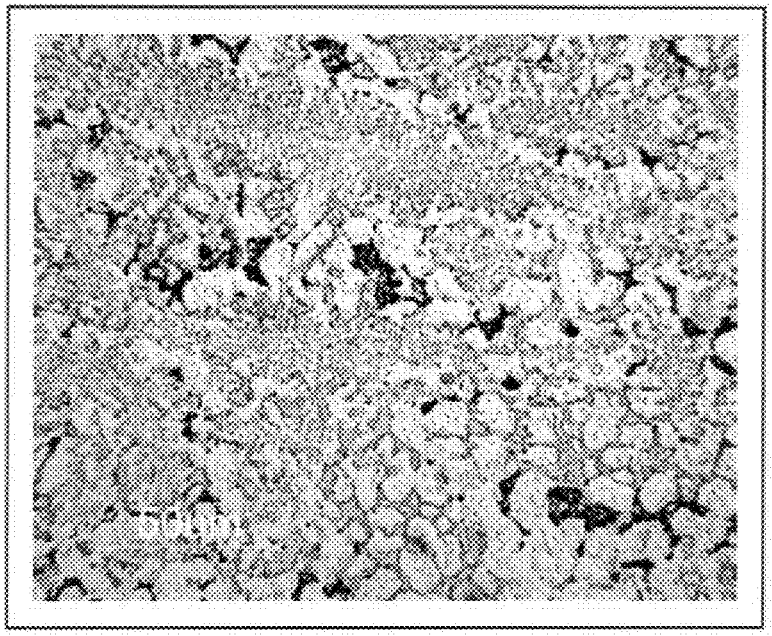
FIG. 4 is micrograph illustrating a the castable high temperature aluminum alloy microstructure of FIG. 3 at 500 times magnification.

FIG. 3 illustrates a micrograph showing the microstructure of the $\alpha$Al—$Al_3$(REM) primary eutectic grains of the same aluminum alloy of FIG. 2 at 200 times magnification that is investment cast under controlled solidification. FIG. 4 shows a micrograph showing the microstructure of the $\alpha$Al—$Al_3$(REM) primary eutectic grains of the cast aluminum alloy of FIG. 3 at 500 times magnification. The microstructure has typical levels of structural refinement. By controlling the solidification conditions in the investment casting process, relatively fast cooling rates (~100° C./min) are possible, increasing nucleation and "modification" of the $Al_3(Yb,Y)$ phase to better distribute the $Al_3(Yb,Y)$ phase. There is a significant refinement and reduction in both dendrite arm spacing and interparticle spacing of the eutectic alloy.

The aluminum alloy of the present invention has both a primary eutectic structure ($\alpha Al$-$Al_3(REM)$) and a different secondary eutectic structure ($\alpha Al$—$CuAl_2/Cu_3NiAl_6$). The secondary eutectic structure solidifies last around and between the primary eutectic dendrite arms. At the appropriate composition, the solidified structure is fully eutectic. As the residual interdentritic liquid freezes during solidification, there is some beneficial synergism between the controlled solidification casting process and the secondary eutectic alloy composition, producing a refinement in size and morphology and an improved distribution of the $CuAl_2$-based phase. The secondary eutectic is shown as black script-like structures between the primary eutectic grains in FIGS. 2, 3 and 4.

Figure 5:
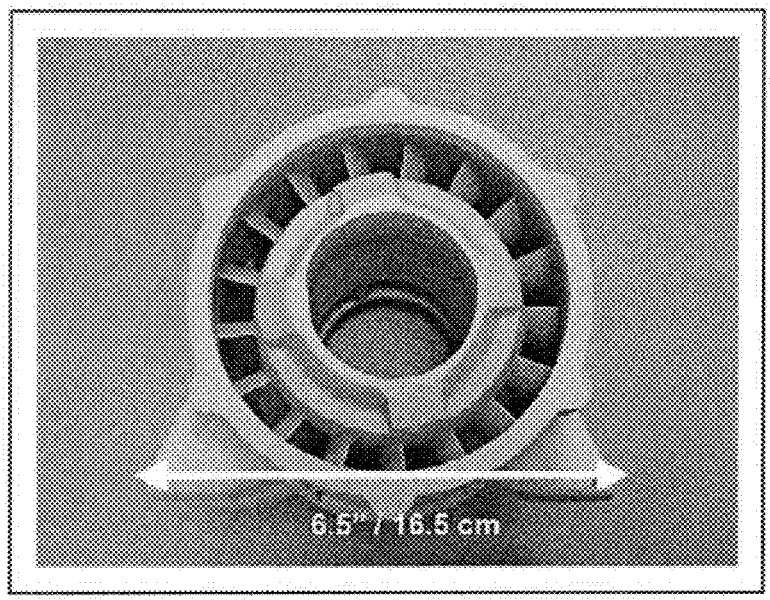
FIG. 5 is a fan housing component cast of a castable high temperature aluminum alloy investment cast using the "controlled solidification" process.

In the present invention, the stress-raising structural features in the eutectic and the relatively coarser, angular morphologies present in non-eutectic alloys (specifically hypereutectic primary $Al_3(REM)$ phases) observed in conventional sand castings are reduced, and their deleterious effects on ductility and notch-sensitivity are moderated. The synergism allows complex castings, such as the fan housing shown in FIG. 5, because there is good fill of the ~0.03" thick guide vanes and the sharp corners in the mold.

The dispersed eutectic particles and the structural refinement in the aluminum alloy also have a significant beneficial effect on the fatigue properties of the aluminum alloy. For a given test temperature, the fatigue/endurance ratio (i.e., the fatigue strength at $10^7$ cycles (endurance limit) divided by the ultimate tensile strength) is a measure of fatigue performance.

Figure 6:
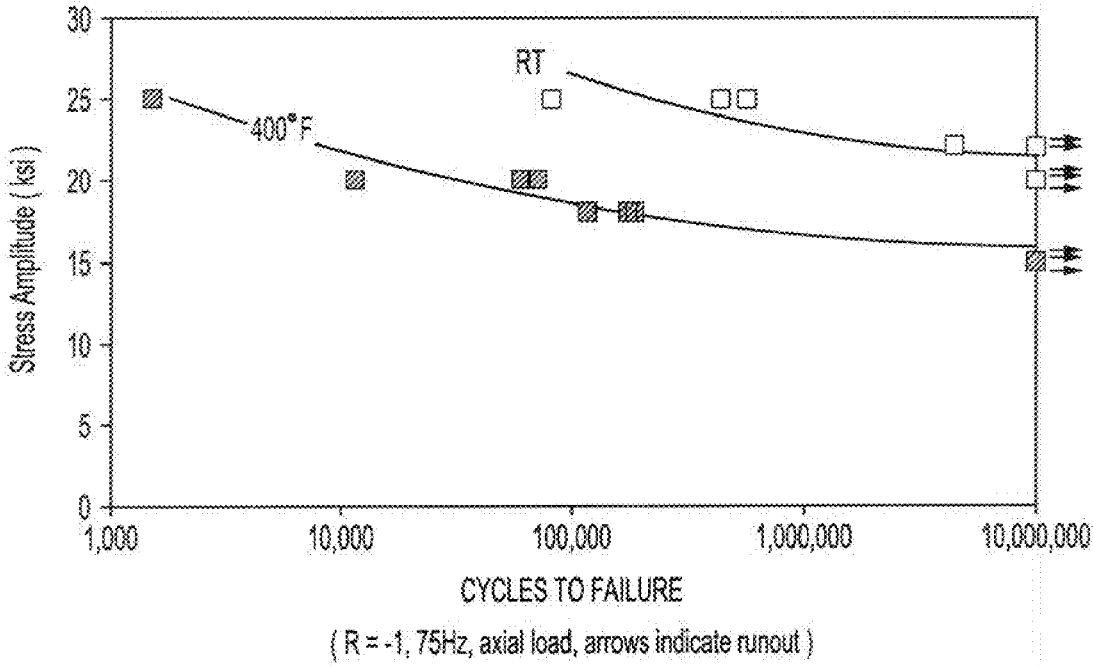
FIG. 6 is a plot of cycles of failure verses stress amplitude of a given aluminum alloy.

FIG. 6 shows typical high cycle fatigue characteristics of the aluminum alloy, where the endurance limits at room temperature and 400° F. are estimated to be >20 ksi and >15 ksi, respectively. At corresponding ultimate tensile strength values of ~36 ksi and ~30 ksi, respectively, the endurance ratios are ~0.6 (room temperature) and ~0.5 (400° F.), respectively. Compared with conventional aluminum alloys (endurance ratio is typically <0.3), the aluminum alloy of the present invention has a high fatigue strength and behaves like aluminum matrix composites and oxide dispersion strengthened wrought alloys. However, the aluminum alloy is not limited by the ceramic particles in the aluminum matrix composites (which remain brittle at any use temperature), nor by the restriction as-fabricated on part complexity inherent in wrought alloys.

At elevated temperatures such as 260° C., the zinc-magnesium-based precipitates of the aluminum alloy are re-solutioned, leaving the copper and nickel based (~538° C.) and ytterbium/yttrium-based (~632° C.) eutectics as the primary strengthening phases. Nickel provides high temperature strength and stability to the copper based eutectic to toughen the precipitate to time/temperature effects and reduce the coefficient of expansion, which is relatively high based on shrinkage observations. The solid solubility limit of nickel in aluminum is ~0.04%, above which it forms insoluble intermetallics. However, nickel has complete solid solubility in copper and can alloy with and strengthen the $CuAl_2$ eutectic phase to form a $Cu_3NiAl_6$ based eutectic phase. Atomic nickel substitutions in the copper lattice effectively improve the high temperature strength of the copper based eutectic. There is an inter-dependence of these elements, driven by respective solubility levels and atomic substitution in the $CuAl_2$ lattice.

Figure 7:
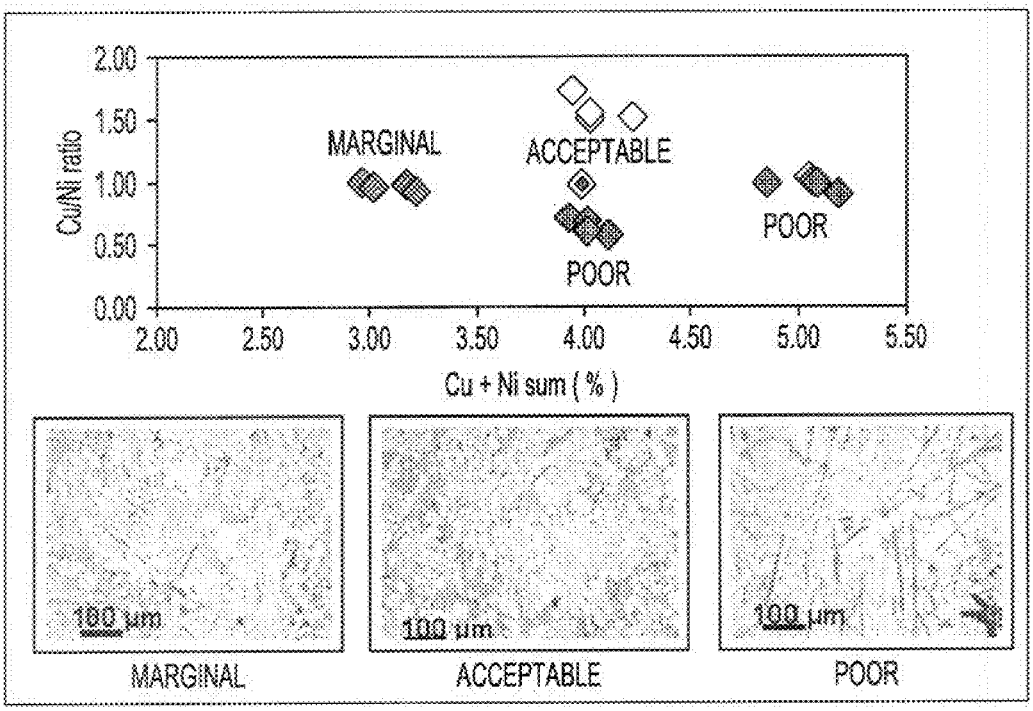
FIG. 7 is a plot of a copper/nickel ratio versus a copper plus nickel sum for a series of alloy compositions indicating trends in microstructural variation that is generated by analyzing the properties of the three illustrated micrographs.

The quantity of copper and nickel has an effect on the microstructure of the aluminum alloy. FIG. 7 illustrates the effect of the copper/nickel ratio and the copper plus nickel sum on the microstructure of the aluminum alloy. The as-cast plus hot isostatically pressed microstructures of seventeen investment cast aluminum alloys produced using controlled solidification cooling rates of ~10-100° C./min were graded as acceptable, marginal or poor based on the degree of refined uniform structure and the presence of any detrimental phases (e.g., non-uniform or lathe-like). The microstructures were compared against the copper/nickel ratio and the copper plus nickel sum parameters, indicating a correlation between the microstructure of the aluminum alloy and the copper and nickel levels for a given solidification rate. The mechanical properties of the aluminum alloys (hardness, RT tensile, 260° C. tensile) also correlate with the microstructure vs. the copper/nickel ratio and the copper plus nickel sum relationship.

TABLE 1

Effects of Cu/Ni ratio and Cu + Ni sum on 260° C. tensile properties

| Alloy | Cu % | Ni % | Cu/Ni | Cu + Ni % | 0.2% YS ksi | UTS ksi | Total El at Fail (%) | Microstructure Rating |
|---|---|---|---|---|---|---|---|---|
| A | 2.42 | 1.61 | 1.50 | 4.03 | 16 | 21 | 8 | Acceptable |
| B | 2.48 | 2.7 | 0.92 | 5.18 | 17 | 18 | 2 | Poor |

Table 1 shows the effects of the copper/nickel ratio and the copper plus nickel sum on alloys A and B, which have essentially the same composition except for the copper and nickel levels. The strength/ductility and the microstructure of alloy A are preferable to alloy B. For an aluminum alloy cast under higher solidification rate conditions typical of investment casting (~50-200° C./min, e.g., ~100° C./min) and die casting (~5000-50,000° C./min, e.g. ~10,000° C./min), the copper/nickel ratio parameter of the aluminum alloy should be greater than approximately 1.0, and the copper plus nickel sum parameter of the aluminum alloy should be less than approximately 4.5%. More preferably, the copper/nickel ratio parameter is greater than approximately 1.5, and the copper plus nickel sum parameter is less than approximately 4.0%.

For an aluminum alloy cast under slow solidification rates such as sand casting (~5-50° C./min, e.g., ~10° C./min), the copper/nickel ratio parameter should be greater than approximately 1.0, and the copper plus nickel sum parameter should be less than approximately 4.0%. Preferably, the copper/nickel ratio parameter is greater than approximately 2.0, and the copper plus nickel sum parameter is less than approximately 3.5%.

Figure 8:
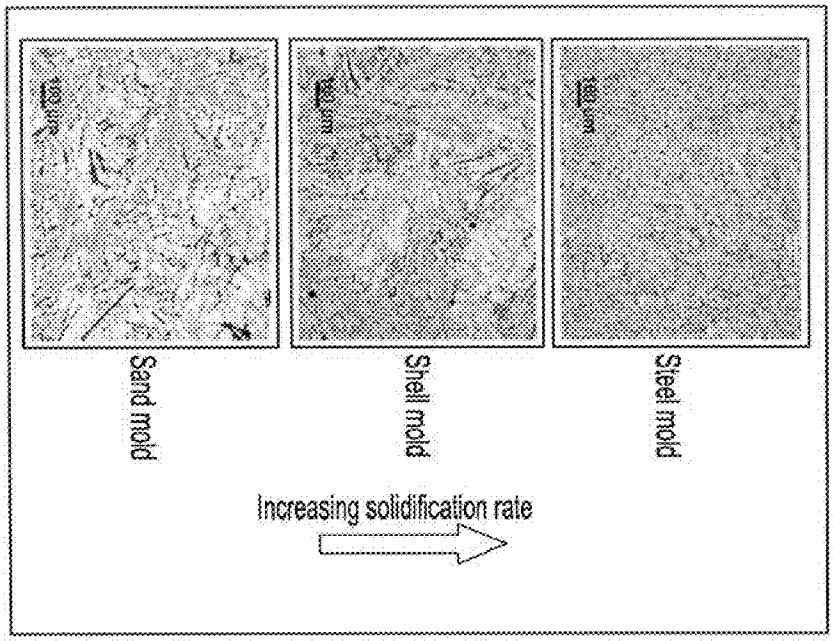
FIG. 8 is a series of micrographs indicating the effect of increasing the solidification rate on the microstructure of the aluminum alloy.

FIG. 8 shows a series of micrographs showing the effect of solidification rates on the microstructure of a given aluminum alloy at different types of casting. The copper/nickel ratio (0.5) and the copper+nickel sum (3%) of the aluminum alloy are not optimized for solidification rates typical of sand casting (~10° C./min) or investment casting (~100° C./min) with controlled solidification in the quenchant. Die casting (~10,000° C./min) has a high solidification rate and is preferred as it can suppress and refine the formation of deleterious phases, e.g., the darker lathe-like, nickel-rich precipitates.

TABLE 2

Compositions of Alloys C and D

| Alloy | Yb | Y | Cu | Ni | Zn | Mg | Ag | Ca | Sr | Al |
|---|---|---|---|---|---|---|---|---|---|---|
| C | 13.5 | 3.6 | 2.0 | 1.0 | 3.0 | 1.0 | 1.0 | 0.2 | 0.05 | Bal |
| D | 13.5 | 3.6 | 2.0 | 0.5 | 0.5 | 1.0 | 1.0 | 0.2 | 0.05 | Bal |

Figure 9:
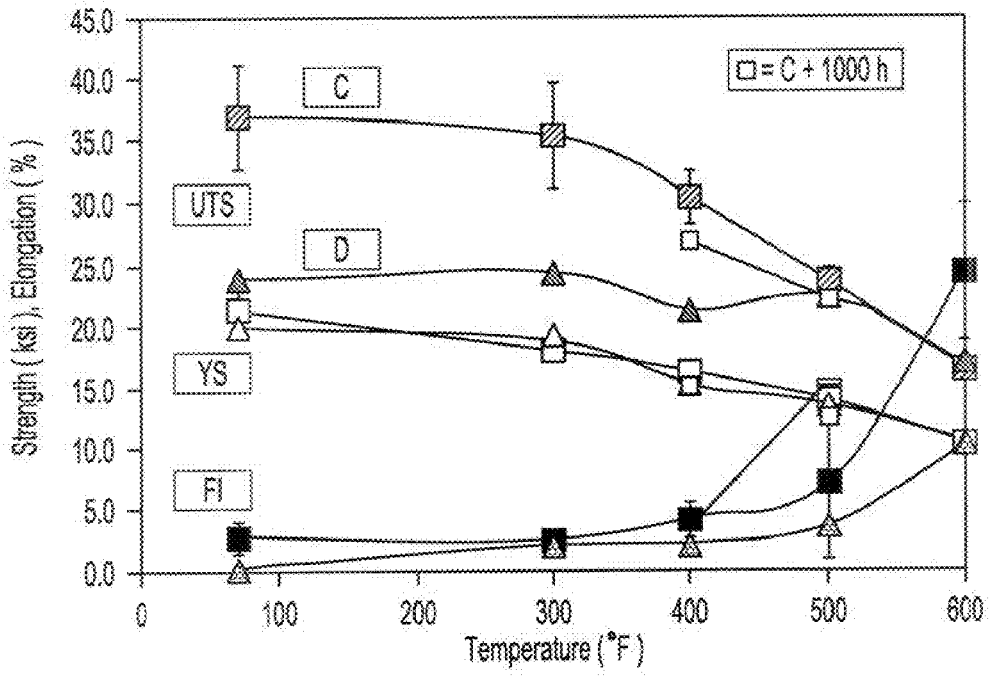
FIG. 9 is a chart showing the effects of increasing the zinc and nickel content on tensile properties of the aluminum alloy.

The effects of zinc based precipitation at lower temperatures and nickel toughening the copper-based eutectic to high temperature exposure are illustrated in Table 2 and FIG. 9. Alloy C has a higher zinc content than alloy D, which generally increases the alloy strength from RT through intermediate temperatures by zinc-magnesium-based precipitation hardening. These precipitates are fully resolutioned above ~400° F. and provide little strengthening. The strengths of the low-zinc alloy D and the high-zinc alloy C are about equal at ~500° F. Tensile test specimens held at temperatures for 1000 hours and then removed from the high temperature environment (open squares) show only a relatively minor drop in properties.

Nickel strengthens the alloy at intermediate temperatures to a much lesser extent than zinc-based precipitates, but is intended to toughen the copper based eutectic by increasing its resistance to resolutionizing at higher temperature/time combinations. This essentially extends the stability of the secondary (i.e., copper based) eutectic and contributes to the major stabilizing effect obtained from the primary (i.e., ytterbium/yttrium based) eutectic particles. An alloy is designed that maintains long-term strength at high temperatures.

The aluminum alloy cast under controlled solidification also has an increased pitting resistance. Aluminum alloys of the present invention (C and D) and several commercial alloys (1, 2 and 3) were subjected to standard potentiodynamic polarization tests (in 3.5% NaCl solution at RT using ASTM G3-89 and G102-89) to measure corrosion rates. Samples of the same alloys were subjected to an extended, accelerated salt spray test involving combinations of spray, humidity and dry-off cycles using a test solution of 3.5% NaCl+0.35% $(NH_4)_2SO_4$. The samples were examined at time intervals up to 630 hours and then sectioned for pit depth measurements.

TABLE 3

Comparison of corrosion rate and pit depth of Al-based alloys

| Alloy | Composition (wt %) | | | | | | | | | | | Corrosion Rate | Max pit depth |
|---|---|---|---|---|---|---|---|---|---|---|---|---|---|
| No. | Yb | Y | Zn | Cu | Mg | Sr | Ag | Mn | Ca | Cr | Ni | (mm/y) | (micron) |
| 1 | | | | 4.4 | 1.5 | | | 0.6 | | | | 0.01 | 300 |
| 2 | | | | 0.25 | 1.0 | 0.6 | | | | 0.25 | | 0.03 | 350 |
| 3 | | | | 1.2 | 0.5 | 5.0 | | | | | | 0.03 | 500 |
| E | 13 | 3.5 | 3.0 | 1.5 | 0.5 | | 0.5 | 0.2 | 0.4 | | 0.1 | 0.05 | 180 |
| F | 13 | 3.5 | 3.0 | 0.5 | 0.5 | | 0.5 | 0.2 | 0.2 | | 0.1 | 0.05 | 190 |

Table 3 shows that the general corrosion rate of the aluminum alloys E and F, investment cast using controlled solidification, is slightly higher than commercial alloys 1, 2 and 3. However, the maximum pit depth decreases. Pitting attack in the commercial alloys occurs via grain boundary penetration and is the major cause of structural failure from corrosion fatigue and stress corrosion cracking. Typically, the precipitate density is high relative to the grain interior, exacerbating the galvanic attack between the precipitate and the αAl matrix. In the aluminum alloy produced by the present invention, the eutectic phases αAl and the adjacent $Al_3(Yb,Y)$ or $(Cu,Ni)Al_2$ are in a fine alternating array and uniformly dispersed either within primary eutectic grains or intergranular secondary eutectic. The net effect of the structural refinement and uniform eutectic phase distribution disperses corrosion attack evenly across the aluminum alloy. Anodizing is typically used to improve the corrosion resistance of aluminum alloys. Preliminary trials on aluminum alloys have demonstrated that their resistance to corrosion is improved by anodizing.

The foregoing description is exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention.

What is claimed is:

1. A method of casting an aluminum alloy, the method comprising the steps of:

forming the aluminum alloy including aluminum, nickel, copper, at least one rare earth element selected from the group consisting of ytterbium, gadolinium, yttrium, erbium and cerium, and at least one minor alloy element selected from the group consisting of zinc, silver, magnesium, strontium, manganese, tin, calcium, cobalt and titanium, wherein the copper and the nickel form a eutectic microstructure, and the aluminum alloy includes a quantity of nickel and a quantity of copper, wherein a sum of the quantity of copper plus the quantity of nickel is less than approximately 4.5% and a ratio of the quantity of copper to the quantity of nickel is greater than approximately 1.0;

controlling solidification of the aluminum alloy in a quenchant.

2. The method as recited in claim 1 wherein the step of controlling solidification forms a plurality of insoluble particles with the at least one rare earth element.

3. The method as recited in claim 1 further including the step of adding approximately 1.0 to 20.0% by weight of the at least one rare earth element.

4. The method as recited in claim 1 further including the step of adding approximately 0.1 to 15.0% by weight of the at least one minor alloy element.

5. The method as recited in claim 1 further including the step of adding approximately 1.0 to 20.0% by weight of a first rare earth element selected from the group consisting of ytterbium and gadolinium and approximately 0.1 to 10.0% by weight of a second rare earth element selected from the group consisting of gadolinium, erbium, yttrium and cerium if the first rare earth element is ytterbium or the group consisting of ytterbium, erbium, yttrium and cerium if the first rare earth element is gadolinium.

6. The method as recited in claim 5 wherein the first rare earth element comprises approximately 12.5 to 15.0% ytterbium and the second rare earth element comprises approximately 3.0 to 5.0% yttrium.

7. The method as recited in claim 6 wherein the first rare earth element comprises approximately 12.9 to 13.2% ytterbium and the second rare earth element comprises approximately 3.0 to 4.0% yttrium.

8. The method as recited in claim 1 further including the steps of determining an optimal composition of the aluminum alloy and controlling a solidification rate of the aluminum alloy.

9. The method as recited in claim 1 further including the step of heating the quenchant to approximately 100° C.

10. The method as recited in claim 1 wherein the quenchant comprises water and a water soluble material.

11. The method as recited in claim 1 further comprising the step of pouring the aluminum alloy into an investment casting shell, wherein the step of controlling solidification comprises first cooling the aluminum alloy at a bottom of the investment casting shell and then propagating the solidification upwardly towards a top of the investment casting shell.

12. The method as recited in claim 1 further including the step of pouring the aluminum alloy into an investment casting shell, and wherein the step of controlling solidification comprises lowering the investment casting shell containing the aluminum alloy into the quenchant at a desired rate.

13. The method as recited in claim 1 wherein the nickel has complete solid solubility in the copper.

14. The method as recited in claim 1 wherein a quantity of the copper and a quantity of the nickel effects the eutentic microstructure of the aluminum alloy.

15. The method as recited in claim 1 wherein the aluminum alloy includes approximately 0.5 to 5.0% copper by weight and approximately 0.1 to 4.5% nickel by weight.

16. The method as recited in claim 15 wherein the aluminum alloy includes approximately 1.0 to 3.0% copper by weight and approximately 0.5 to 1.5% nickel by weight.

17. The method as recited in claim 1 wherein a higher composition of the copper and the nickel is used with one of investment casting and die casting, and a lower composition of the copper and the nickel is used with sand casting.

18. A method of casting an aluminum alloy, the method comprising the steps of:

forming the aluminum alloy including aluminum, nickel, at least one rare earth element selected from the group consisting of ytterbium, gadolinium, yttrium, erbium and cerium, and at least one minor alloy element selected from the group consisting of copper, zinc, silver, magnesium, strontium, manganese, tin, calcium, cobalt and titanium;

controlling solidification of the aluminum alloy in a quenchant, wherein the step of controlling solidification of the aluminum alloy forms a primary eutectic microstructure and a secondary eutectic microstructure.

19. The method as recited in claim 18 wherein the step of controlling solidification of the aluminum alloy forms the primary eutectic microstructure and the secondary eutectic microstructure in one step.

20. The method as recited in claim 19 wherein the at least one minor alloy element is copper.

21. The method as recited in claim 18 wherein the at least one rare earth element forms the primary eutectic microstructure and the at least one minor alloy element forms the secondary eutectic microstructure.

22. The method as recited in claim 21 wherein the at least one minor alloy element is copper.

23. The method as recited in claim 21 wherein the step of controlling solidification of the aluminum alloy forms a plurality of insoluble particles formed of the at least one rare earth element to form the primary eutectic microstructure.

24. The method as recited in claim 21 wherein the step of controlling solidification of the aluminum alloy forms a plurality of insoluble particles, wherein said plurality of particles contributes to corrosion resistance and elevated temperature strength.

25. The method as recited in claim 1 wherein the aluminum alloy is formed by casting.

26. The method as recited in claim 18 wherein the aluminum alloy includes a quantity of nickel and a quantity of copper, wherein a sum of the quantity of copper plus the quantity of nickel is less than approximately 4.5% and a ratio of the quantity of copper to the quantity of nickel is greater than approximately 1.0.

* * * * *